US006332800B2

(12) United States Patent
Kodama

(10) Patent No.: US 6,332,800 B2
(45) Date of Patent: Dec. 25, 2001

(54) CONNECTOR ASSEMBLY HAVING INERTIA LOCKING MECHANISM

(75) Inventor: Shinji Kodama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/840,187

(22) Filed: Apr. 24, 2001

(30) Foreign Application Priority Data

May 25, 2000 (JP) ..... 12-155237

(51) Int. Cl.[7] ..... H01R 13/627
(52) U.S. Cl. ..... 439/357; 439/358
(58) Field of Search ..... 439/353, 354, 439/357, 358, 35, 372

(56) References Cited

U.S. PATENT DOCUMENTS 4,010,998 * 3/1977 Tolnar, Jr. et al. ..... 439/358
5,830,002 * 11/1998 Ito et al. ..... 439/358
5,876,232 3/1999 Matsushita et al. ..... 439/357

FOREIGN PATENT DOCUMENTS 9-293566 11/1997 (JP) .

* cited by examiner

*Primary Examiner*—Tulsidas Patel
(74) *Attorney, Agent, or Firm*—Armstrong, Westerman, Hattori, McLeland & Naughton, LLP

(57) ABSTRACT

The connector lock mechanism has a receptacle connector and a plug connector which are engaged with each other. The receptacle connector has a first lock portion and a first inertia locked portion. The plug connector has a second lock portion and a second inertia locked portion. The first lock portion is engaged with second lock portion. The first inertia locked portion is engaged with the second inertia locked portion. The first lock portion has a first locking piece and a push piece that moves the first locking piece. The first inertia locked portion has a lock arm provided with a second locking piece. The second lock portion has a third locking piece that engages with the first locking piece after abutment thereof or when the push piece is depressed. The second inertia locked portion has a fourth locking piece engaged with the second locking piece after a temporary resistance force against the mating of the connectors is produced

5 Claims, 9 Drawing Sheets

CONNECTOR ASSEMBLY HAVING INERTIA LOCKING MECHANISM

BACKGROUND OF THE INVENTION

1. Field of the Invention

The present invention relates to a connector assembly having a lock mechanism using a connector mating inertia force.

2. Related Art

Such connector assemblies each have a lock mechanism using a connector mating inertia force. The mechanism provides a temporary resistance force during mating of associated connectors. A further mating force overcomes the resistance force, and the release of the resistance force is perceived by a worker. An inertia force produced with the release of the resistance force brings the associated connectors into a correct mating state thereof. One of such inertia locked connector assemblies is disclosed in Japanese Patent Application Laid-open No. H. 9-293566.

In FIG. 8 or 9, reference numeral 1 designates a plug connector fitted on an electrical instrument 2. Reference numeral 3 designates a receptacle connector mated with the plug connector 1. The plug connector 1 has a connector housing 4 and a plurality of pin terminals 5 (only one of them is illustrated). The connector housing 4 is generally fitted on the electrical instrument 2. The pin terminal 5 is extended in a mating space 6 formed in the connector housing 4. In the outside of the mating space 6, that is, on an outer surface of the connector housing 4, there is formed a second inertia locked portion 7 of the plug connector. The second inertia locked portion 7 has a hook-shaped lock piece 8.

The receptacle connector 3 has a connector housing 9 and a plurality of female terminals 10 (only one of them is illustrated) received in the connector housing 9. The connector housing 9 engages with the connector housing 4 of the plug connector 1. The female terminal 10 is received in a terminal accommodation chamber 11 formed in the connector housing 9. The female terminal 10 is electrically connected to the pin terminal 5 at the mating of the connectors. The connector housing 9 has a mating space 12, and the plug connector 1 has a mating space 6. The mating space 12 is formed with a lock portion 13 that engages with a locked portion 7 formed on the plug connector. The lock portion 13 includes a resilient lock arm 14. The resilient lock arm 14 has a hook-shaped lock piece 15 positioned at a forward end thereof and a push piece 16 positioned at rear end thereof. The push piece 16 can release the mating of the connectors.

At the mating of the connectors, the lock piece 8 of the plug connector abuts against the lock piece 15 of the receptacle connector. At that time, the abutment of the pieces produces a resistance force. To overcome the resistance force A, a further advance of the receptacle connector 3 engages the lock piece 8 with the lock piece 15 (see FIG. 9).

Meanwhile, the depression of the push piece 16 moves the lock piece 15 of the receptacle connector to release the mating of the connectors.

However, in the prior art described above, the receptacle connector 3 might be mated with the plug connector 1, while the push piece 16 is in its depressed state. Since the mating of the connectors causes no abutment of the lock piece 8 against the lock piece 15, an incomplete mating of the connectors may occurs.

A worker might fail to perceive the incomplete mating of the connectors when the push piece 16 is in the depressed state.

SUMMARY OF THE INVENTION

In view of the disadvantage described above, an object of the present invention is to provide an inertia locked connector assembly that can surely provide a temporary abutment force to prevent an incomplete mating of the connectors.

For achieving the object, an aspect of the present invention is a connector assembly having a lock mechanism using a connector mating inertia force. The connector assembly includes:

a first connector and a second connector which are mated with each other, wherein the first connector has a first lock portion and a first inertia locked portion, and the second connector has a second lock portion and a second inertia locked portion, the first lock portion engaged with second lock portion, the first inertia locked portion engaged with the second inertia locked portion, the first lock portion having a first locking piece and a push piece that moves the first locking piece, the first inertia locked portion having a lock arm provided with a second locking piece, the lock arm being deflectable independently from the first lock portion, the second lock portion having a third locking piece that engages with the first locking piece after abutment thereof or when the push piece is depressed, the second inertia locked portion having a fourth locking piece abutted against the second locking piece.

As described above, the push piece for disengaging the connectors is provided on the lock portion of the receptacle connector. Thus, even when the connectors are mated with the push piece being depressed, the first inertia locked portion of the receptacle connector cooperates with the second inertia locked portion of the plug connector, providing a resilient force released at the sliding abutment of the inclined surfaces thereof. Accordingly, the worker can surely perceive the resilient force on a complete mating of the connectors, preventing an incomplete mating of the connectors.

Preferably, the second locking piece and the fourth locking piece each have an inclined surface slidingly engaged with each other when the first and second connectors disengage from each other or when the lock arm returns to its original position.

Thus, the second locking piece and the fourth locking piece are smoothly released from each other. The returning resilient force of the lock arm is exerted on the inclined surface of the fourth locking piece, enhancing the connectors to move toward the complete mating position.

Preferably, the second locking piece abuts against the fourth locking piece before the first locking piece abuts against the third locking piece.

Thus, at the mating of the connectors, an appropriate resistance force is obtained. Furthermore, when the lock arm returns to its original position, the resilient force of the lock arm enhances the engagement of the first locking piece with the third locking piece.

DETAILED DESCRIPTION OF THE PREFERRED EMBODIMENT

Referring to the accompanied drawings, an embodiment of the present invention will be discussed hereinafter.

Figure 1:
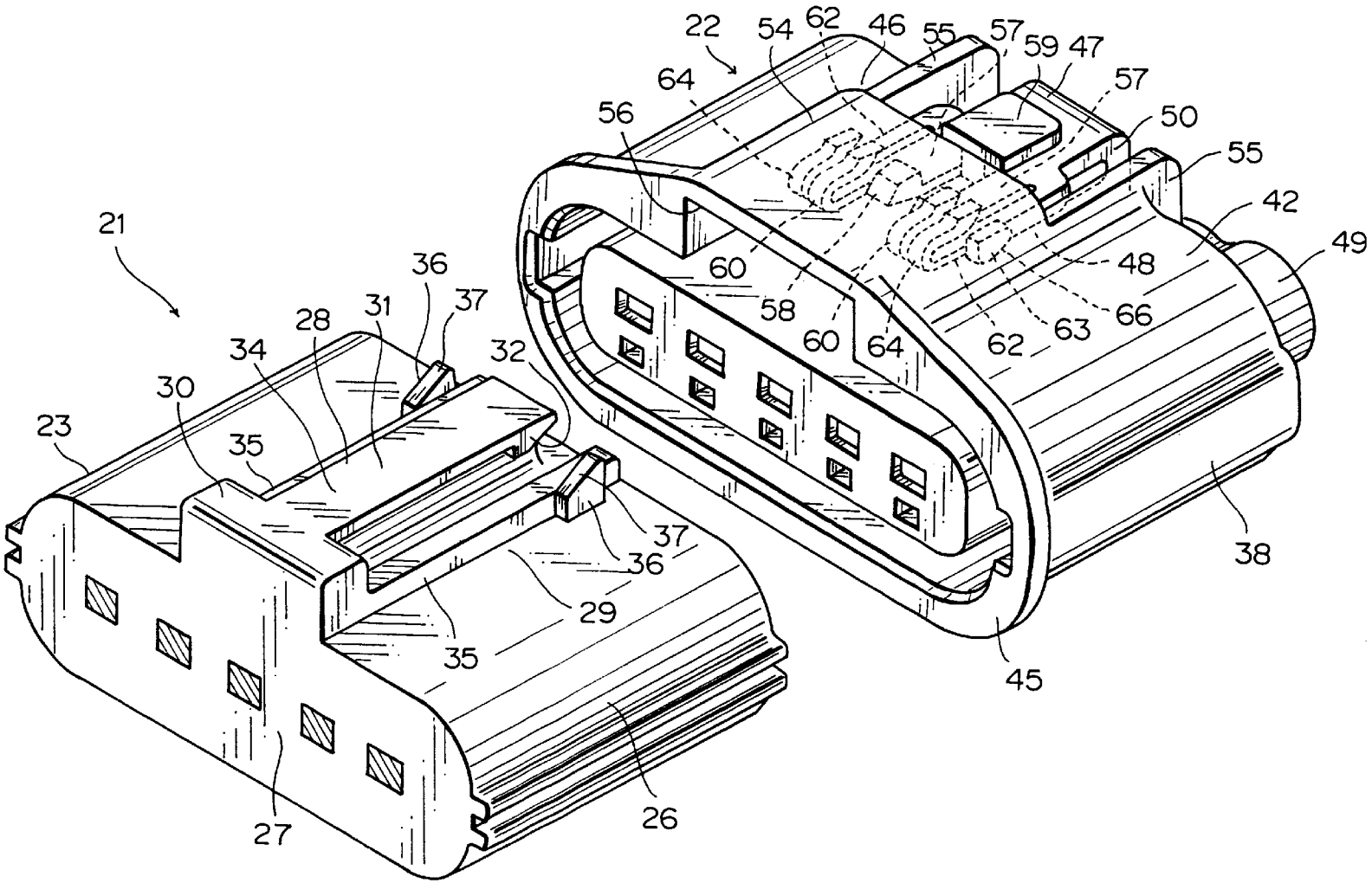
FIG. 1 is a perspective view showing an embodiment of an inertia locked connector assembly according to the present invention.

In FIG. 1, reference numeral 21 designers a plug connector assembled into an electrical instrument (not shown). Reference numeral 22 designates a receptacle connector mated with the plug connector 21. The mated plug connector 21 and receptacle connector 22 are called as an inertia locked connector assembly that can surely provide an inertia force at the mating of the connectors. The plug connector 21 corresponds to the second connector described in the invention summary, while the receptacle connector 22 corresponds to the first connector.

Figure 2:
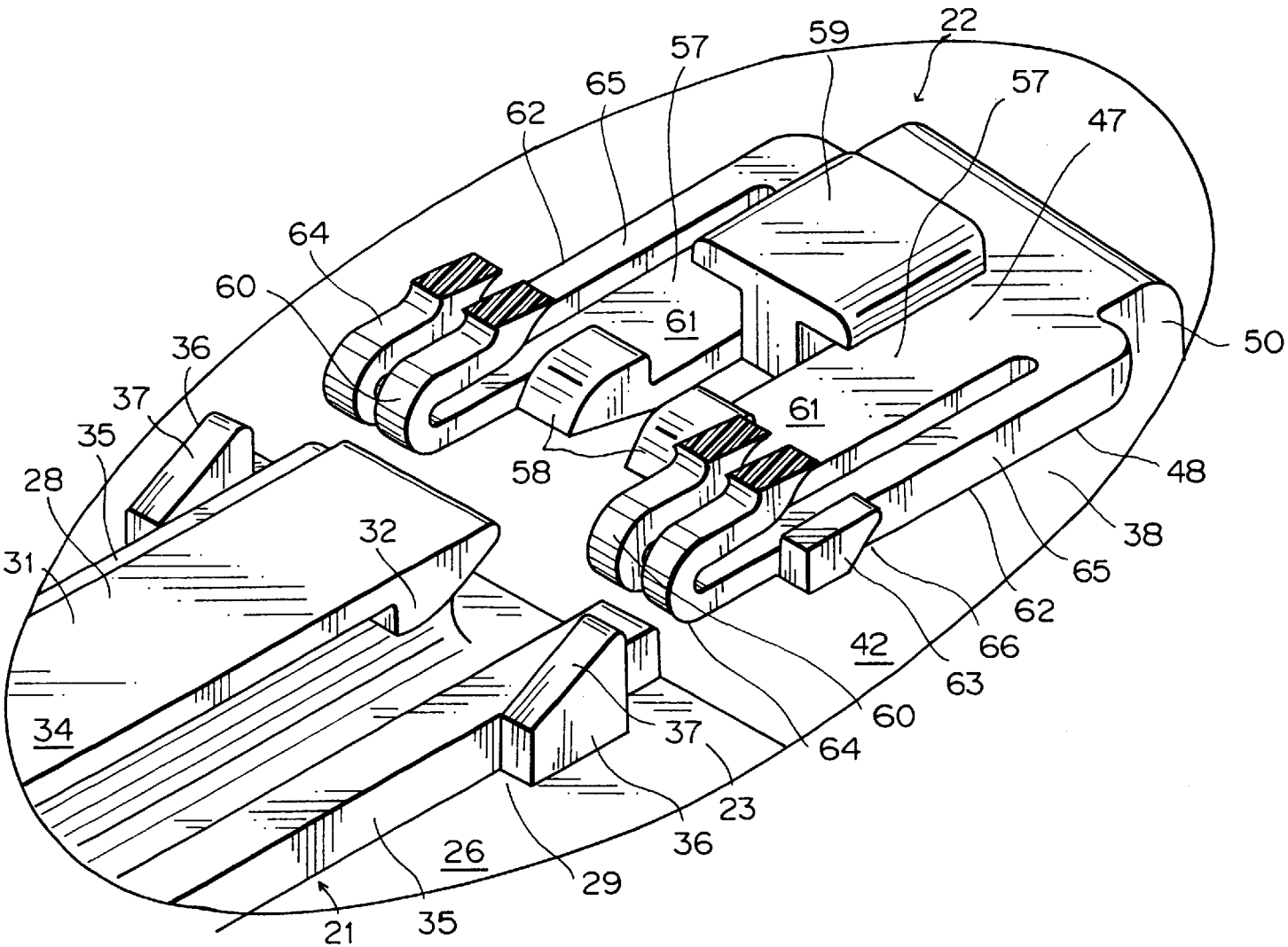
FIG. 2 is an enlarged perspective view showing a first lock portion formed on a receptacle connector, a first inertia locked portion formed on the receptacle connector, a second lock portion formed on a plug connector, and a second inertia locked portion formed on the plug connector, which are in a disengaged state thereof.

Next, referring to FIGS. 1 to 3, the constitution of the embodiment will be discussed.

The plug connector 21 has a connector housing 23 fitted to the electrical instrument (not shown) and a plurality of pin terminals 24 (only one of them is illustrated in FIG. 3). The connector housing 23 is made of an insulating synthetic resin material and has a mating space 25 for the receptacle connector 22. The mating space 25 is defined by a peripheral wall 26 and an inner end wall 27 of the connector housing 23. The connector housing 23 is of a cylindrical shape having a bottom to define the mating space 25. The peripheral wall 26 has an opening edge with a tapered surface engaged with a packing 40 described later. On an upper surface of the peripheral wall 26 of the plug connector, there is formed a second lock portion 28 and a second inertia locked portion 29.

In the descriptions of the specification and the accompanied drawings, an area in which there are provided the second lock portion 28 and the second inertia locked portion 29 of the plug connector is defined as an upper side. Another area opposed to the upper side is defined as a lower side. A direction perpendicular to the vertical direction is defined as a left or right direction that is not the mating direction of the connectors. For the plug connector 21, a direction toward the receptacle connector 22 is defined as a forward direction, and another direction opposed to the forward direction is defined as a rear direction. For the receptacle connector 22, the forward, rear, left, and right directions are defined adversely as compared with the plug connector 21.

The second lock portion 28 of the plug connector has a base portion 30 projecting on an upper surface of the plug connector, a longitudinally extended lock arm 31, and a pair of third locking pieces 32, 32 (only one of them is illustrated). First, second, and fourth locking pieces will be discussed later. The base portion 30 is a rectangular body continuous with the inner end wall 27. The lock arm 31 extends from a forward middle portion of the base portion 30. The lock arm 31 has a horizontal wall 34 and a vertical wall 33 to define a T-shape in section. The third locking pieces 32, 32 each are formed in a hook shape on a fore end of the horizontal wall 34. The third locking pieces 32 has a thickness gradually increased backward (a tapered thickness).

The second inertia locked portion 29 of the plug connector is provided in each of left and right outer sides of the lock arm 31. The second inertia locked portions 29 are constituted by a pair of extended bars 35, 35 and a pair of fourth locking pieces 36, 36. The extended bars 35, 35 are projected from the upper surface of the plug connector and are contiguous with the base portion 30 at backward ends thereof. The extended bar 35 has a fore end flush with a forward end of the peripheral wall 26. The extended bar 35 has a height less than a half height of the vertical wall 33. The extended bar 35 has a flat upper surface on which a lock arm 62 described later slides. The fourth locking piece 36 is a hook-shaped protrusion and is positioned in a forward end side of the peripheral wall 26. The fourth locking piece 36 is located adjacent to and outside of the extended bar 35.

The fourth locking piece 36 has an inclined surface 37 facing toward the base portion 30. On the inclined surface 37, a second locking piece 63 described later slides. In this embodiment, the inclined surface 37 has an angle, for example, of 30°.

The pin terminals 24 (only one of them is illustrated in FIG. 3) are electrically conductive. The pin terminal 24 is defined in a tab to pass through the inner end wall 27 and is extended into the mating space 25. The pin terminal 24 can be electrically connected to a female terminal 39 (see FIG. 3) described later. Meanwhile, the receptacle connector 22 has a connector housing 38, a plurality of female terminals 39 (only one of them is illustrated in FIG. 3), and a packing 40. The packing 40 is a known one which will not be discussed herein. The connector housing 38 is made of an insulating synthetic resin material and has a mating space 41 for receiving the plug connector 21. The mating space 41 is defined by a peripheral wall 42 and an inner end wall 43 of the connector housing 38 and includes a terminal accommodation portion 44. The peripheral wall 26 of the plug connector 21 is pushed into the mating space 41.

The peripheral wall 42 has a generally oval inner shape fit with the peripheral wall 26 of the plug connector 21. The peripheral wall 42 is formed with an outwardly projecting, circumferential flange 45 at an open end thereof. On an upper surface of the peripheral wall 42 of the receptacle connector, there is formed a lock protector 46, a first lock portion 47, and a first inertia locked portion 48.

On the inner end wall 43 of the receptacle connector, there is formed a terminal insertion portion 49 for the female terminals 39 and a base portion 50. The base portion 50 supports the first lock portion 47 and the first inertia locked portion 48. The terminal insertion portion 49 has an cylindrical shape and is contiguous with the terminal accommodation chamber 44.

The terminal accommodation chamber 44 is formed with a through hole for the pin terminal 24 and a lance 51 for locking the female terminal 39. Note that a wall of the terminal accommodation chamber 44, in which the through hole is formed, serves as a stopper for the female terminal 39.

The female terminal 39 received in the terminal accommodation chamber 44 is formed from an electrically conductive metal plate by press molding. The female terminal 39 has an electrical cable connection portion and an electrical contact portion connected to the pin terminal 24. The electrical contact portion has a rectangular box shape and is formed with a resilient contact piece therein. The electrical cable connection portion is contiguous with the electrical contact portion and is connected to an insulator stripped end of an electrical cable 52. The electrical cable 52 is fitted with a watertight rubber seal 53 that intimately contacts with an inner surface of the terminal insertion portion 49. The receptacle connector 22 is a waterproof one.

The lock protector 46 includes a protection hood 54 and a pair of partitions 55, 55. The protection hood 54 is a swelled upper wall of the peripheral wall 42. The partitions 55, 55 protect the base portion 50. The flange 45 is formed with an opening 56 contiguous with an inner space of the protection hood 54. The opening 56 is configured to fit with the second lock portion 28 and the second inertia locked portion 29 of the plug connector 21.

The first lock portion 47 of the receptacle connector has a pair of lock arms 57, 57, a pair of first locking pieces 58, 58, and a push piece 59. At the mating of the plug connector 21 and the receptacle connector 22, the first lock portion 47 engages with the second lock portion 28 of the plug connector. Each lock arm 57 has a U-shaped resilient member 60 and a resilient flat plate portion 61. The U-shaped resilient member 60 has an end contiguous with an inner surface of the protection hood 54 and has another end continuous with the resilient flat plate portion 61. The U-shaped resilient members 60, 60 can provide a resilient reaction force when compressed.

The resilient flat plate portion 61 extends in a longitudinal direction of the connector housing 38. The resilient flat plate portion 61 has an end contiguous with an upper end of the base portion 50. The resilient flat plate portion 61 is perpendicular to the base portion 50.

Each first locking piece 58 has a hook shape and is formed on an end of the resilient flat plate portion 61. The first locking piece 58 engages with the third locking piece 32. Each third locking piece 32 slidingly abuts against a tapered surface of the first locking piece 58. This sliding abutment causes the lock arm 57 to resiliently deform.

The push piece 59 is disposed between the resilient flat plate portions 61 and is contiguous with the flat plate portions 61. The push piece 59 is used at disengagement of the connectors. The push piece 59 serves as a button for resiliently deforming the lock arms 57, 57. The depression of the push piece 59 resiliently deforms the lock arms 57, 57 and displaces the first locking pieces 58, 58. This disengages the first locking pieces 58, 58 from the third locking pieces 32, 32.

The first inertia locked portion 48 of the receptacle connector has a pair of the lock arms 62, 62 and a pair of second locking pieces 63, 63 (only one of them is illustrated). At the mating of the plug connector 21 and the receptacle connector 22, the first inertia locked portion 48 engages with the second inertia locked portion 29 of the plug connector. Each lock arm 62 has a U-shaped resilient curved piece 64 and a bar arm 65. The curved piece 64 is similar to the resilient curved piece 60 of the lock arm 57 of the first lock portion 47 of the receptacle connector. The resilient curved piece 64 has an end contiguous with an inner wall of the protection hood 54 and has the other end contiguous with the bar arm 65.

Both the ends of the resilient curved piece 64 move toward each other at the deformation of the resilient curved piece 64. This movement is opposite in direction to that of the resilient curved piece 60. The arm 65 extends in a longitudinal direction of the connector housing 38. The arm 65 has another end contiguous with a side surface of the resilient flat plate portion 61.

The second locking piece 63 serves as a hook and engages with the fourth locking piece 36. The second locking piece 63 abuts against the fourth locking piece 36 to cause the resilient deformation of the lock arm 62. The second locking piece 63 has an inclined surface 66 slidingly abutted against the inclined surface 37 of the fourth locking piece 36. Note that the surface 66 may not be inclined as far as it can slidingly abut against the inclined surface 37.

Figure 3A:
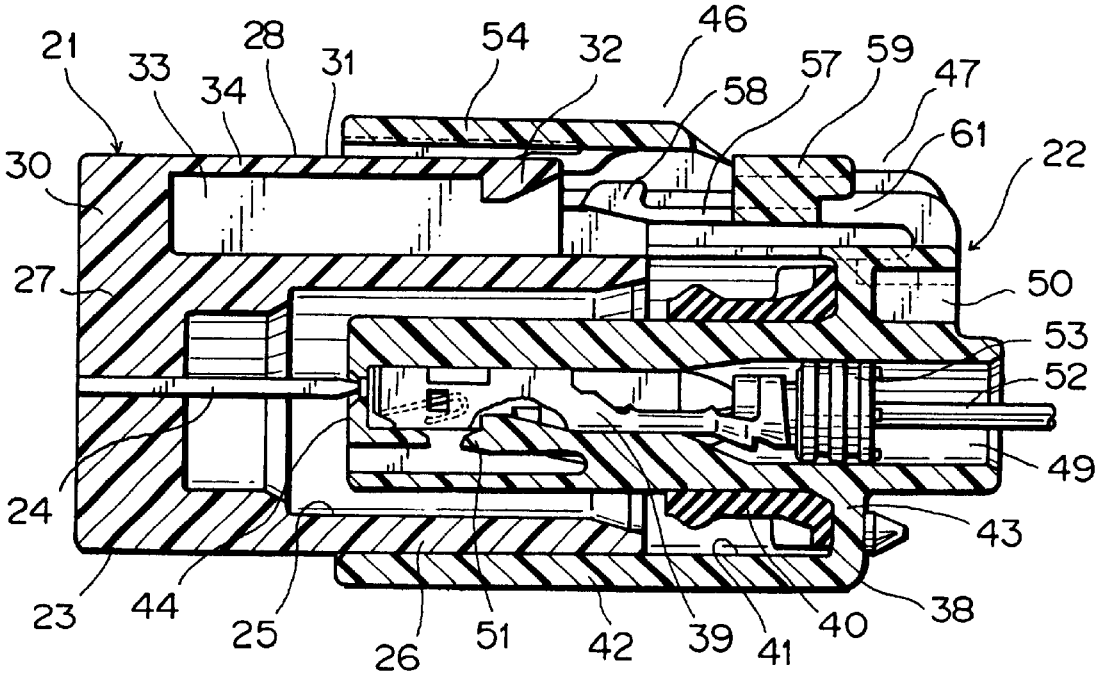
FIGS. 3A and 3B each are a sectional view showing an initial mating state of the connectors, FIG. 3A showing an engagement state of the first lock portion of the receptacle connector with the second lock portion of the plug connector, FIG. 3B showing an engagement state of the first inertia locked portion of the receptacle connector with the second inertia locked portion of the plug connector.
Figure 3B:
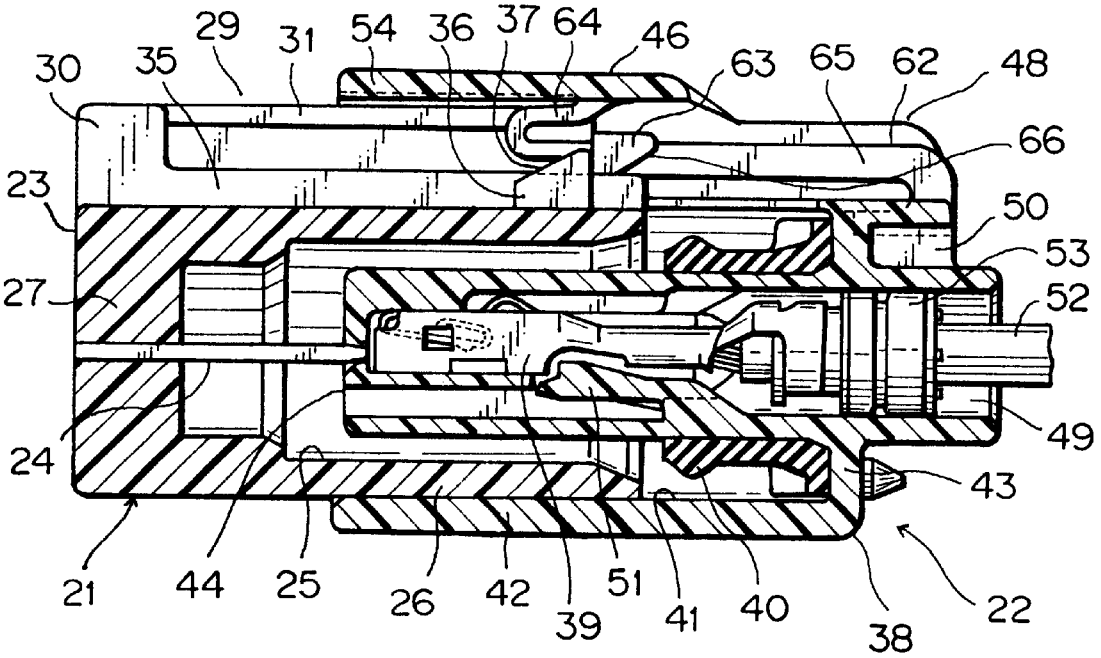
Figure 4A:
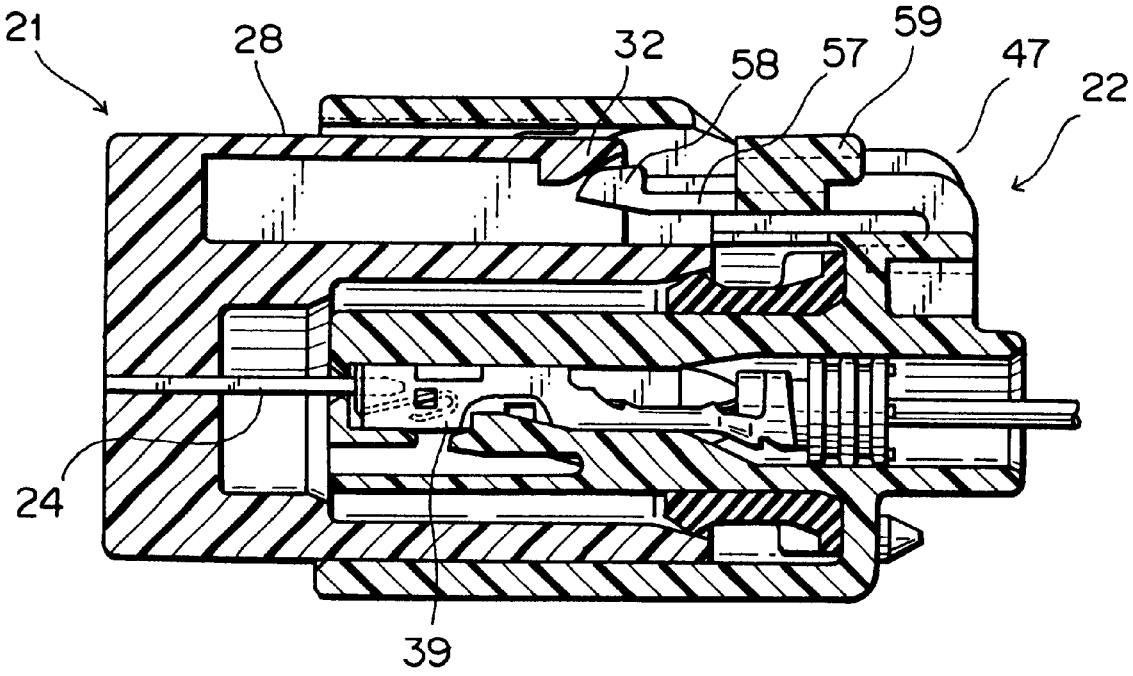
FIGS. 4A and 4B each are a sectional view showing the connectors which are at a halfway stage of the mating thereof (the second locking piece and the fourth locking piece are in a halfway stage of the engagement thereof), FIG. 4A showing an engagement state the first lock portion of the receptacle connector with the second lock portion of the plug connector, FIG. 4B showing an engagement state of the first inertia locked portion of the receptacle connector with the second inertia locked portion of the plug connector.
Figure 4B:
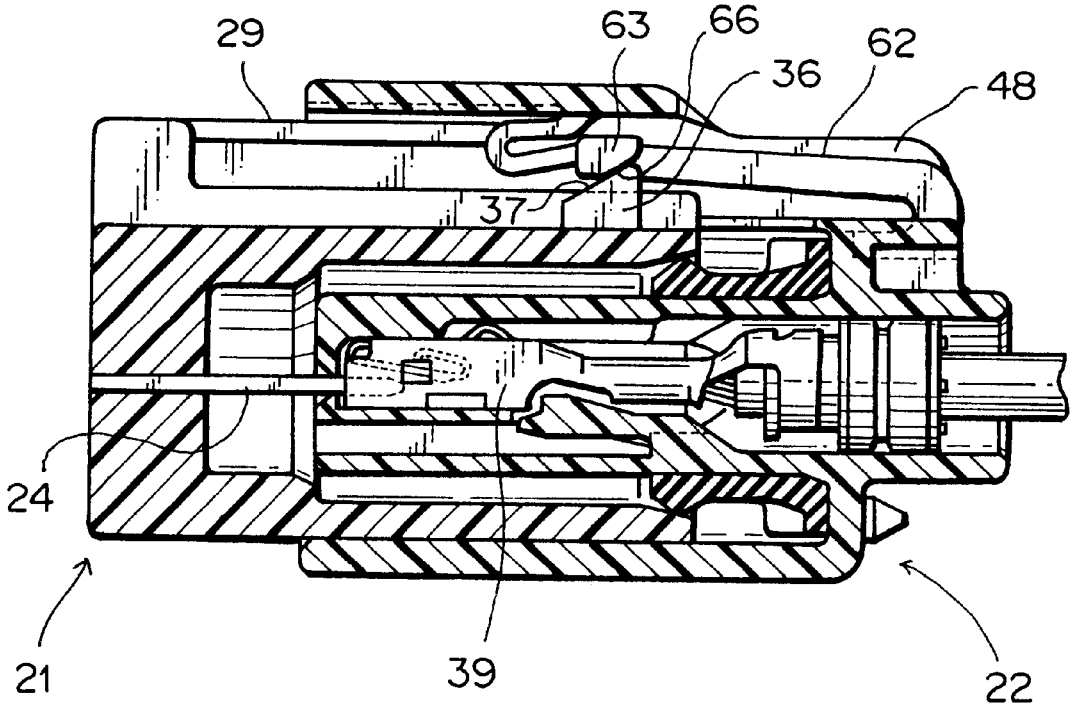
Figure 5A:
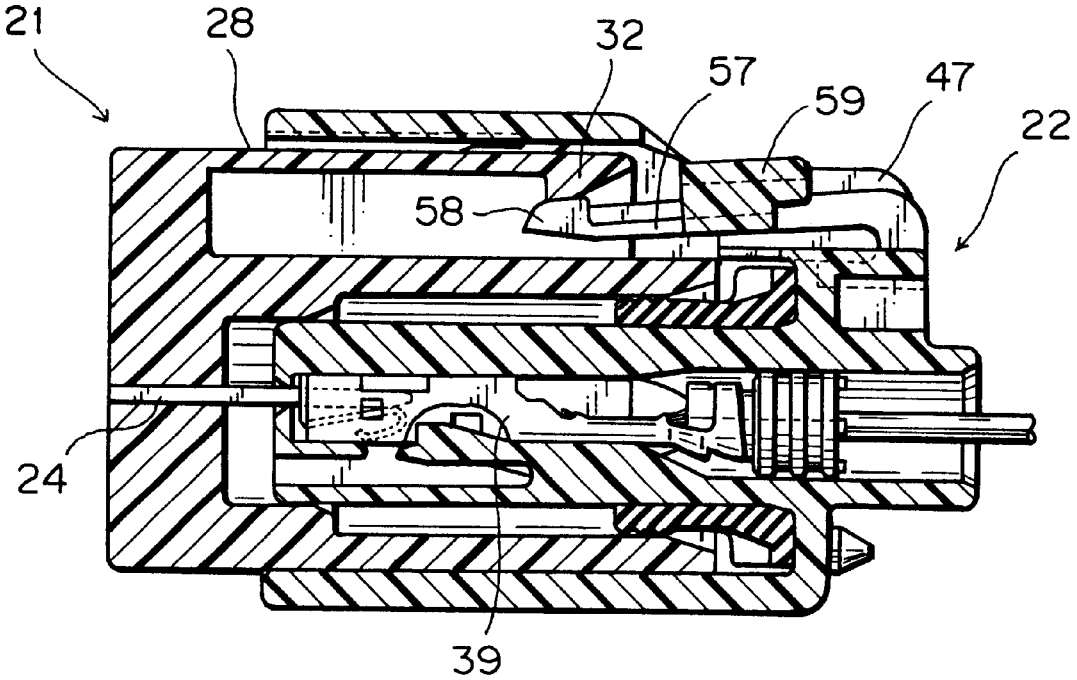
FIGS. 5A and 5B each are a sectional view showing the connectors which are at a halfway stage of the mating thereof (the first locking piece and the third locking piece are at a halfway stage of the engagement thereof), FIG. 5A showing an engagement state of the first lock portion of the receptacle connector with the second lock portion of the plug connector, FIG. 5B showing an engagement state of the first inertia locked portion of the receptacle connector with the second inertia locked portion of the plug connector.
Figure 5B:
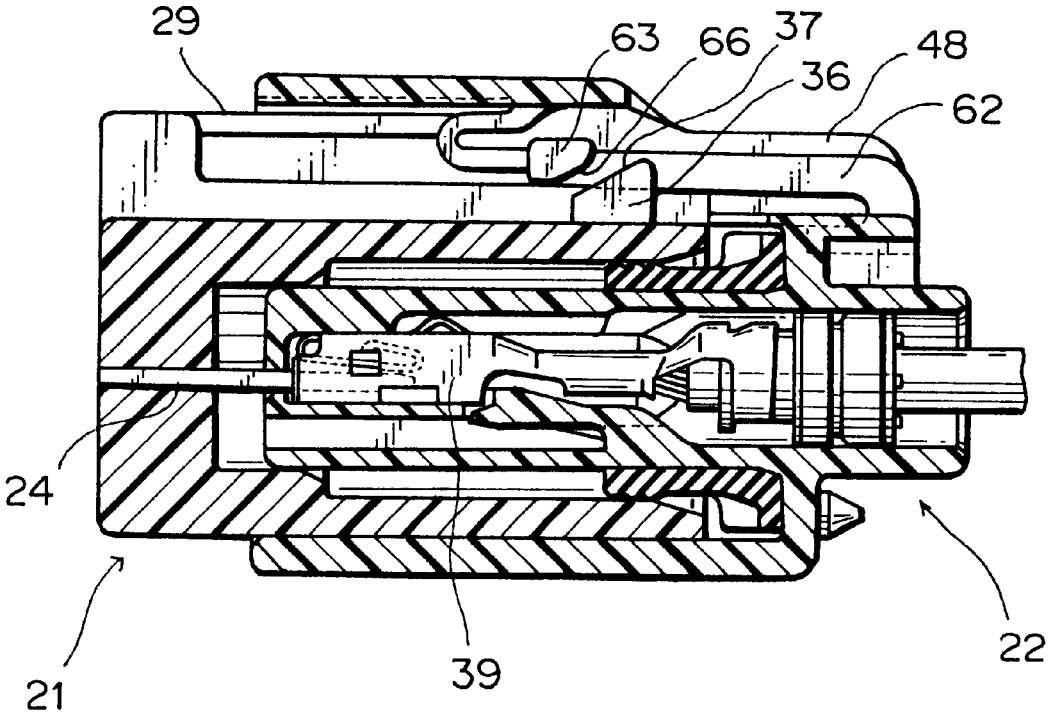
Figure 6A:
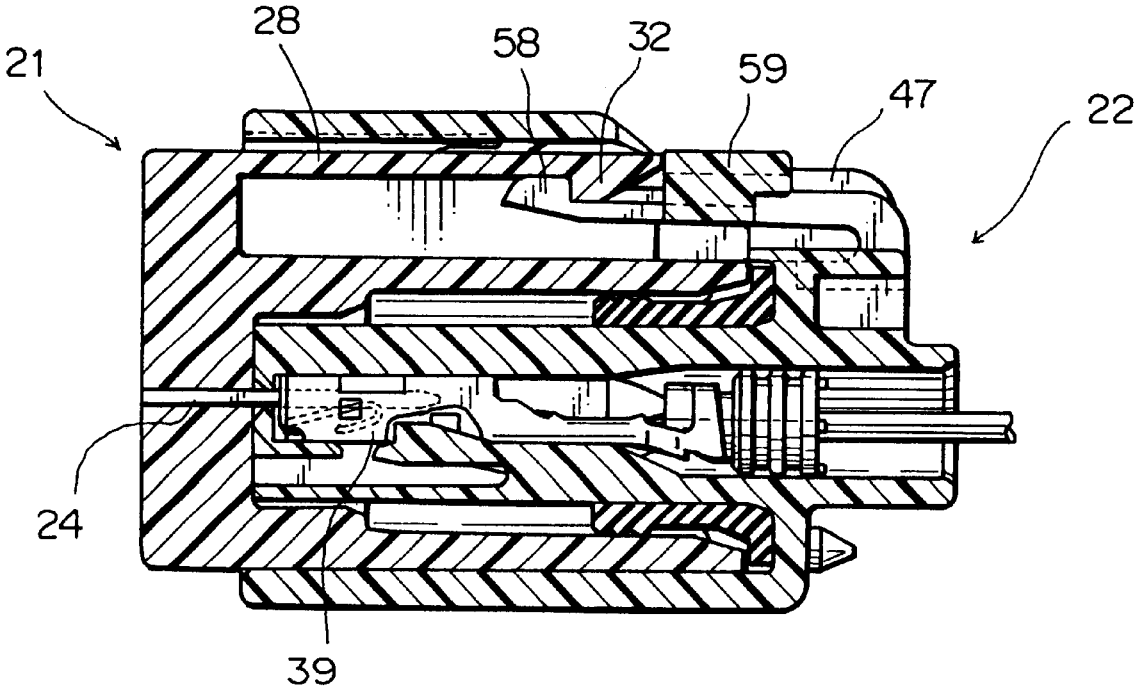
FIGS. 6A and 6B each are a sectional view showing a complete mating state of the connectors, FIG. 6A showing an engagement state of the first lock portion of the receptacle connector with the second lock portion of the plug connector, FIG. 6B showing an engagement state of the first inertia locked portion of the receptacle connector with the second inertia locked portion of the plug connector.
Figure 6B:
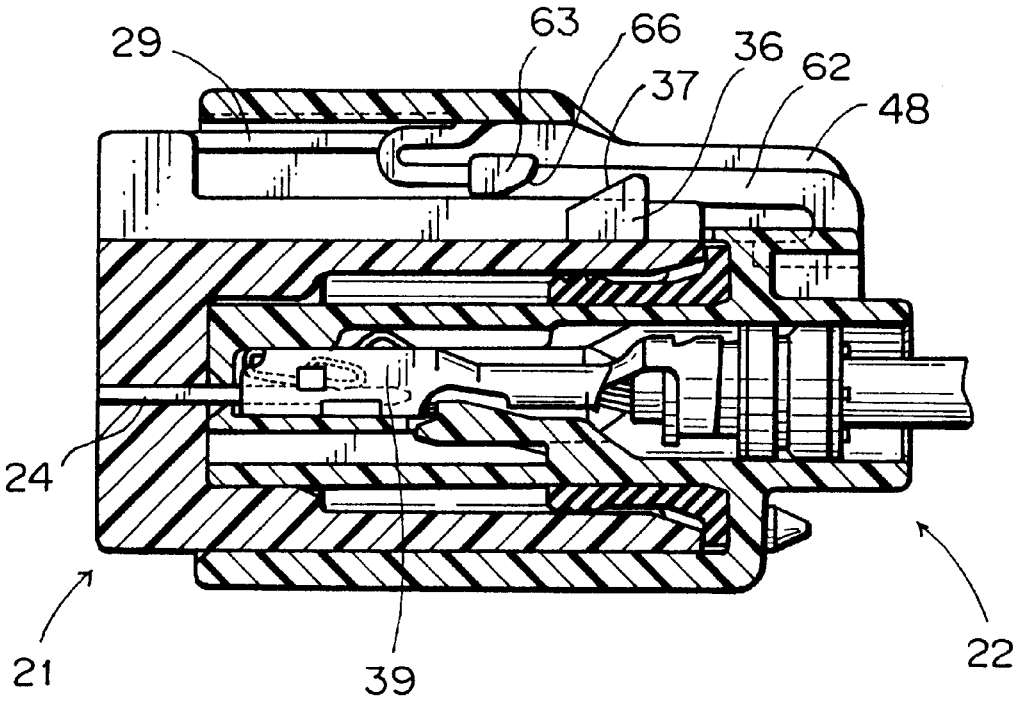

Regarding the configuration described above, mating steps of the plug connector 21 and the receptacle connector 22 will be discussed with referring sequentially to FIGS. 3 to 6. FIGS. 3A and 3B each are a sectional view showing an initial mating state of the connectors. FIGS. 4A and 4B each are a sectional view showing the connectors which are at a halfway stage of the mating thereof (the second locking piece and the fourth locking piece are at a halfway stage of the mating thereof). FIGS. 5A and 5B each are a sectional view showing the connectors which are in a halfway stage of the mating thereof (the first locking piece and the third locking piece are in a halfway stage of the engagement thereof). FIGS. 6A and 6B each are a sectional view showing a complete mating state of the connectors.

As illustrated in FIGS. 3A and 3B, at an initial mating step of the receptacle connector 22 and the plug connector 21, the mating space 41 of the receptacle connector 22 receives the peripheral wall 26 of the plug connector 21, and the mating space 25 of the plug connector 21 receives the terminal accommodation chamber 44 of the receptacle connector 22. A further mating operation of the connectors causes the fourth locking piece 36 to abut against the second locking piece 63. The abutment provides a resistance force against the connector mating action. To overcome the resistance force, the receptacle connector 22 is further pushed to proceed the connector mating. Note that at that time, a fore end of the pin terminal 24 is in the terminal insertion through hole of the terminal accommodation chamber 44.

Referring to FIG. 4, to overcome the resistance force, the receptacle connector 22 is further pushed, so that the lock arms 62, 62 resiliently deflect upward as illustrated in FIG. 4B. Thereby, the inclined surface 66 of the second locking piece 63 rides on the inclined surface 37 of the fourth locking piece 36. The resilient force due to the deformation of the lock arms 62 is exerted on the inclined surface 37. This proceeds the mating of the connectors. After the sliding movement between the inclined surface 66 and the inclined surface 37, the first inertia locked portion 48 of the receptacle connector completely engages with the second inertia locked portion 29 of the plug connector (see FIG. 5B and FIG. 6B). This is advantageous for a worker to clearly perceive the engagement.

When the second locking piece 63 has ridden over the fourth locking piece 36, the first locking piece 58 abuts against the tapered surface of the third locking piece 32 as illustrated in FIG. 4A. Thereby, an inertia mating force of the connectors resiliently deflects the lock arm 57, so that the first locking piece 58 moves to ride over the third locking piece 32. At that time, the fore end of the pin terminal 24 is positioned in a state prior to the contact with the resilient contact piece of the female terminal 39.

As illustrated in FIGS. 5A and 5B, the receptacle connector 22 is further pushed to proceed the mating of the connectors, so that the lock arm 57 resiliently deflects further downward. Thereby, the first locking piece 58 completely rides on the third locking piece 32. Then, as illustrated in FIG. 6A, a further operation of the connector mating causes the third locking piece 32 to ride over the first locking piece 58, resulted in a final engagement of the locking pieces. This completes the sequential steps of the connector mating, and an electrical connection of the pin terminal 24 with the female terminal 39 is also completed.

Figure 7:
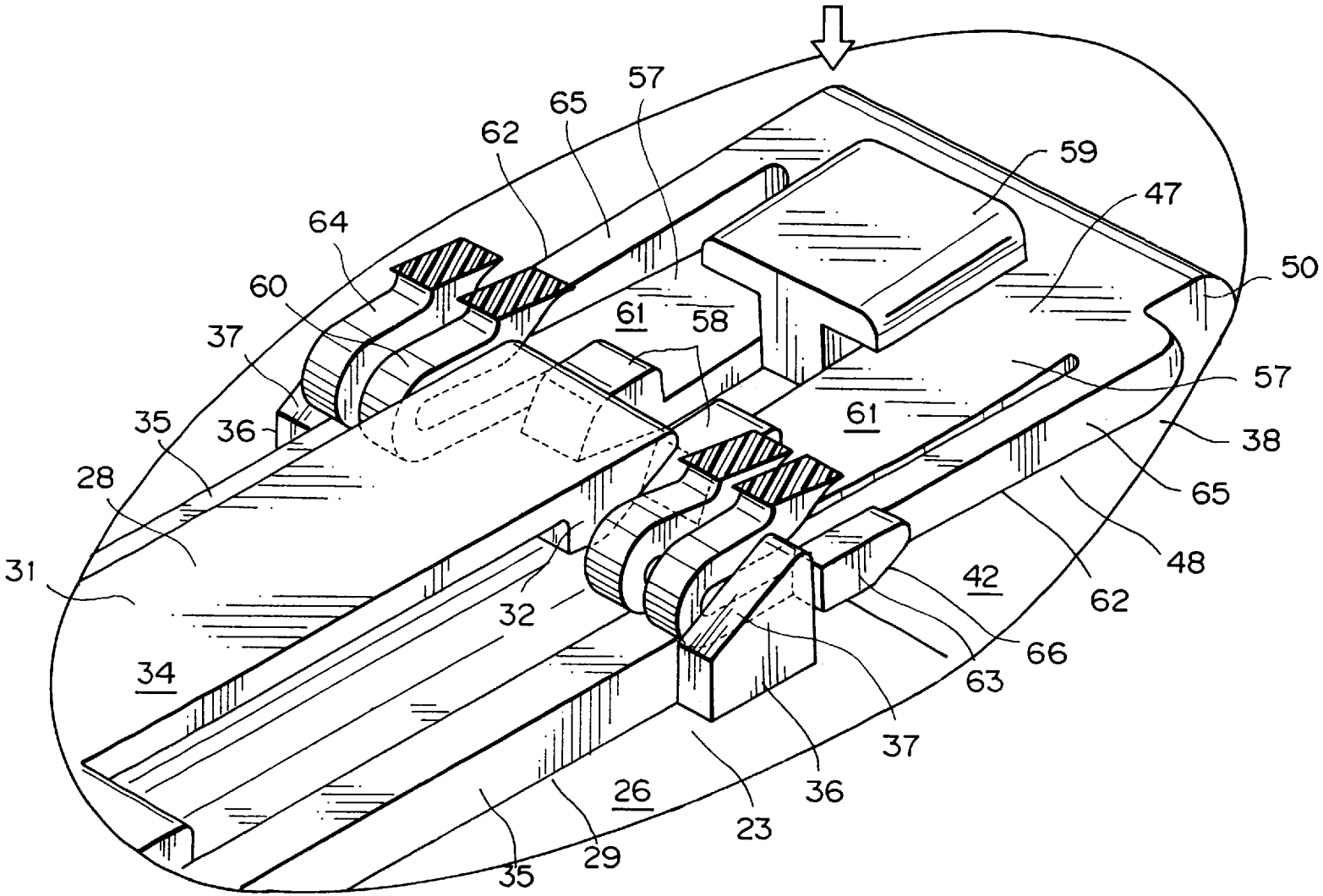
FIG. 7 is an enlarged perspective view showing the first lock portion of the receptacle connector, the first inertia locked portion of the receptacle connector, the second lock portion of the plug connector, and the second inertia locked portion of the plug connector, which are in a disengaged state thereof with a push piece having been depressed.
Figure 8:
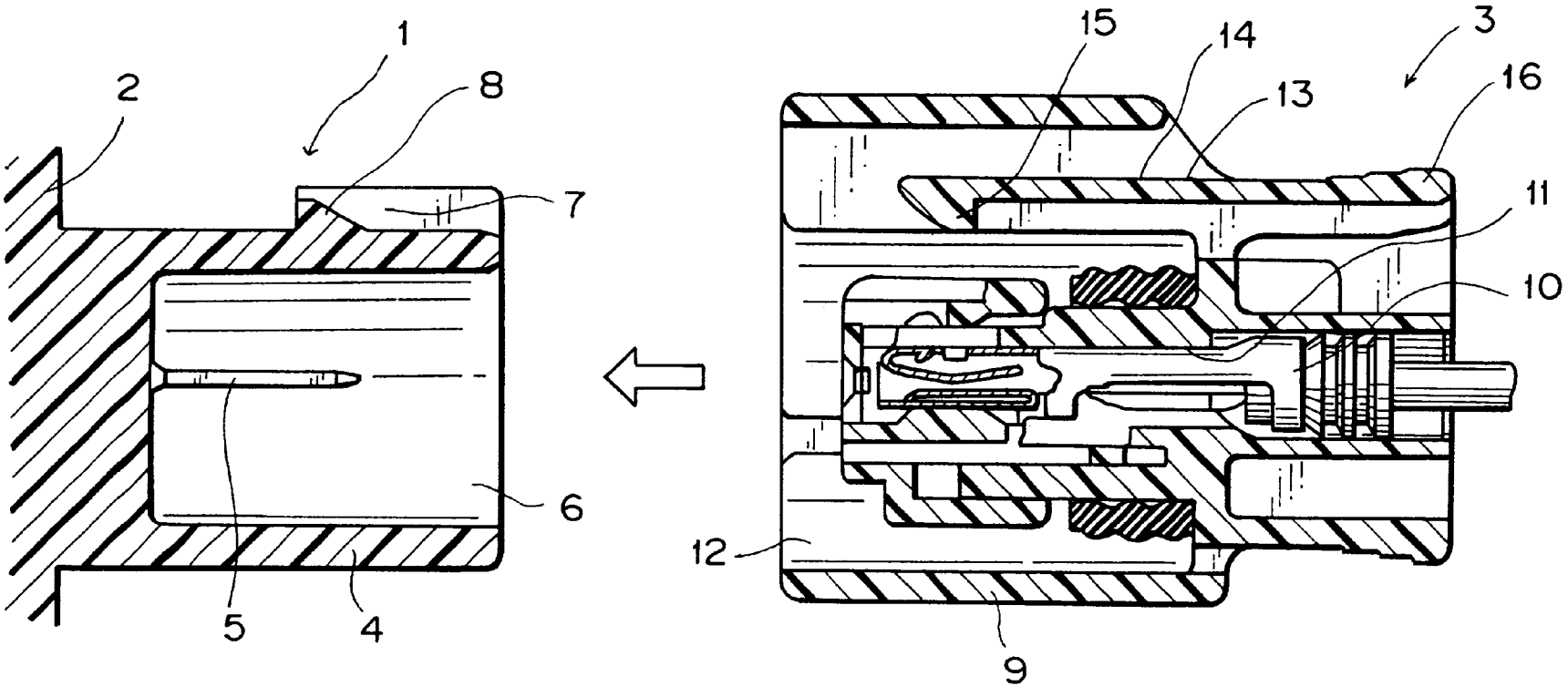
FIG. 8 PRIOR ART
FIG. 8 is a sectional view showing prior-art connectors which are in a state before the mating thereof.
Figure 9:
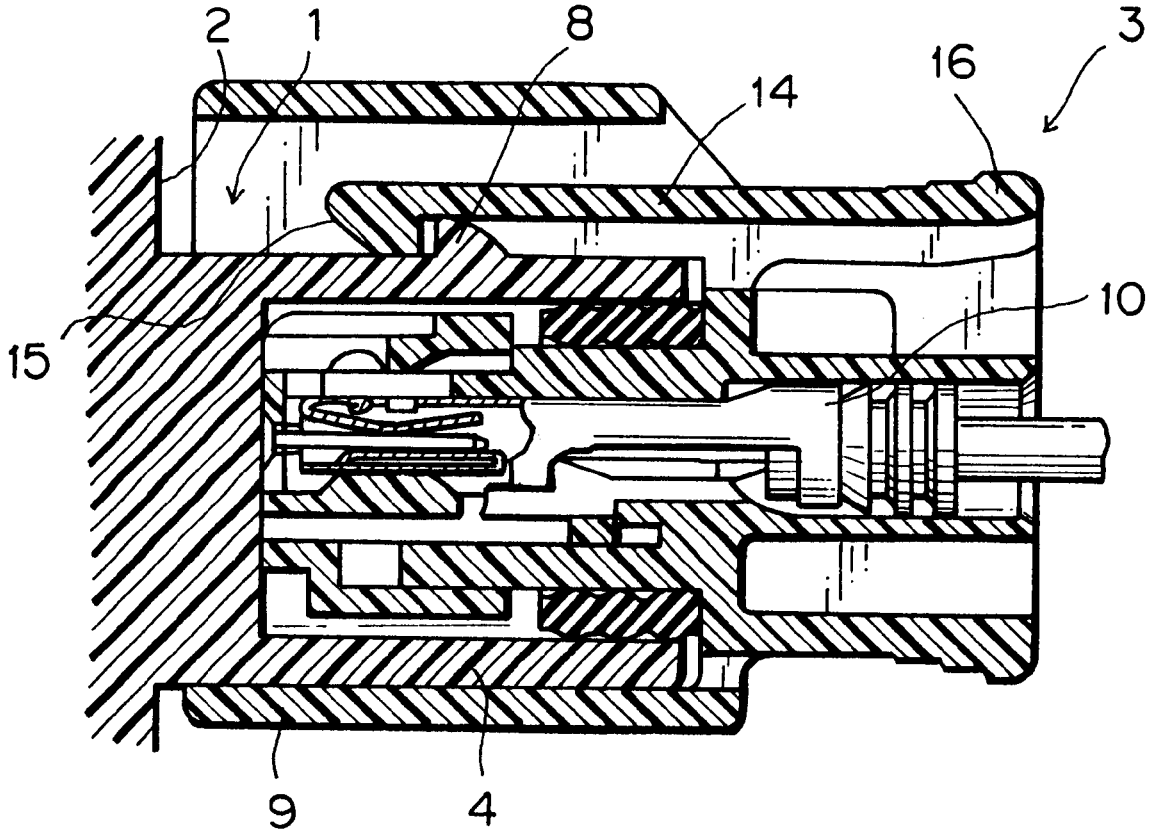
FIG. 9 PRIOR ART
FIG. 9 is a sectional view showing the prior-art connectors which are in a mated state.

To disengage the connectors, the push piece 59 is depressed to move the first locking pieces 58, 58. Thereby, the first locking piece 58 is released from the third locking piece 32, so that the receptacle connector 22 can be pulled out from the plug connector 21. During the disengagement, the second locking piece 63 abuts against the fourth locking piece 36. However, the sliding abutment of the inclined surface 66 against the inclined surface 37 easily resiliently deflects the lock arm 62 upward to allow an easy release of the abutment. As illustrated in FIG. 7, when the connector mating is proceeded with the push piece 59 being in a depressed state, a worker can not perceive the moment when the first locking piece 58 engages with the third locking piece 32. However, the first inertia locked portion 48 of the receptacle connector surely engages with the second inertia locked portion 29 of the plug connector, preventing an incomplete mating of the connectors.

As discussed above, even when the connectors are mated with the push piece 59 being depressed, the first inertia locked portion 48 of the receptacle connector cooperates with the second inertia locked portion 29 of the plug connector, providing a resilient force released at the sliding abutment of the inclined surface 66 against the inclined surface 37. Thus, the worker can surely perceive the resilient force on a complete mating of the connectors, preventing an incomplete mating of the connectors Note that the present invention can be modified within the spirit of the present invention.

What is claimed is:

1. A connector assembly having a lock mechanism using an inertia force, the connector assembly comprising:

a first connector and a second connector which are mated with each other, wherein the first connector has a first lock portion and a first inertia locked portion, and the second connector has a second lock portion and a second inertia locked portion, the first lock portion engaged with second lock portion, the first inertia locked portion engaged with the second inertia locked portion, the first lock portion having a first locking piece and a push piece that moves the first locking piece, the first inertia locked portion having a lock arm provided with a second locking piece, the lock arm being deflectable independently from the first lock portion, the second lock portion having a third locking piece that engages with the first locking piece after abutment thereof or when the push piece is depressed, the second inertia locked portion having a fourth locking piece abutted against the second locking piece.

2. The connector assembly as claimed in claim 1, wherein each of the second locking piece and the fourth locking piece has an inclined surface slidingly engaged with each other when the first and second connectors disengage from each other or when the lock arm returns to its original position.

3. The connector assembly as claimed in claim 1, wherein the second locking piece abuts against the fourth locking piece before the first locking piece abuts against the third locking piece.

4. The connector assembly as claimed in claim 2, wherein the second locking piece abuts against the fourth locking piece before the first locking piece abuts against the third locking piece.

5. The connector assembly as claimed in claim 1, wherein, at the mating of the first and second connectors, the lock arm of the first inertia locked portion slidingly abuts against a projected bar formed on the second inertia locked portion to provide a temporary resistance force against the mating of the connectors before the second locking piece is allowed to engage with the fourth locking piece.

* * * * *